US011498346B2

(12) United States Patent
Takahashi et al.

(10) Patent No.: US 11,498,346 B2
(45) Date of Patent: Nov. 15, 2022

(54) PRINTING APPARATUS FOR BENDING A SHEET TO FORM A LOOP

(71) Applicant: CANON KABUSHIKI KAISHA, Tokyo (JP)

(72) Inventors: Ryutaro Takahashi, Tokyo (JP); Masakazu Nagashima, Kanagawa (JP); Tomohiro Suzuki, Kanagawa (JP); Naoki Wakayama, Kanagawa (JP); Hideyuki Nozawa, Tochigi (JP); Waichiro Saiki, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 17/211,325

(22) Filed: Mar. 24, 2021

(65) Prior Publication Data

US 2021/0309025 A1 Oct. 7, 2021

(30) Foreign Application Priority Data

Apr. 3, 2020 (JP) ..... JP2020-067821

(51) Int. Cl.

| | |
|---|---|
| ***B41J 13/00*** | (2006.01) |
| ***B41J 11/00*** | (2006.01) |
| ***B41J 15/00*** | (2006.01) |
| ***B41J 15/04*** | (2006.01) |
| ***B41J 11/66*** | (2006.01) |

(52) U.S. Cl.

CPC ..... *B41J 13/0009* (2013.01); *B41J 11/006* (2013.01); *B41J 11/0095* (2013.01); *B41J 11/663* (2013.01); *B41J 15/005* (2013.01); *B41J 15/04* (2013.01)

(58) Field of Classification Search

CPC .. B41J 13/0009; B41J 11/006; B41J 11/0095; B41J 11/663; B41J 15/005; B41J 15/04

See application file for complete search history.

(56) References Cited

FOREIGN PATENT DOCUMENTS

| | | | | |
|---|---|---|---|---|
| JP | 2005-193418 A | | 7/2005 | |
| JP | 2015108651 | * | 6/2015 | ..... B65H 9/14 |

* cited by examiner

*Primary Examiner* — Henok D Legesse

(74) *Attorney, Agent, or Firm* — Canon U.S.A., Inc. I.P. Division

(57) ABSTRACT

A printing apparatus, comprising a storage unit for storing a sheet, a printing unit for printing on the sheet conveyed by a first conveyance unit from the storage unit, a second conveyance unit, provided between the first conveyance unit and the storage unit, for conveying the sheet from the storage unit toward the first conveyance unit, a conveyance control unit for controlling driving of the first and the second convey units such that the sheet is bent between the first conveyance unit and the second conveyance unit, and a detection unit, provided between the first and the second conveyance units, for detecting bending of the sheet, wherein the conveyance control unit stops conveyance of the sheet by the first conveyance unit based on a detection result of the detection unit.

19 Claims, 8 Drawing Sheets

PRINTING APPARATUS FOR BENDING A SHEET TO FORM A LOOP

BACKGROUND

Field of the Disclosure

The present disclosure generally relates to a printing apparatus.

Description of the Related Art

Some printing apparatuses include a storage unit that stores a roll sheet, a printing unit that performs printing, and a conveyance unit that conveys the sheet from the storage unit to the printing unit, and performs printing to the sheet and cutting of the sheet in parallel (Japanese Patent Laid-Open No. 2005-193418). Upon conveying the sheet, by making the driving force (rotation speed, that is, conveyance amount per unit time) of a conveyance roller on the upstream side in the conveyance path larger than that of a conveyance roller on the downstream side, bending of the sheet, which is referred to as a loop, is formed between the conveyance rollers. Thereafter, printing to the sheet can be performed by maintaining driving of the conveyance roller on the downstream side and, at the same time, cutting of the sheet can be performed while the loop is decreased by stopping the conveyance roller on the upstream time.

In order to improve the quality of printing by the printing apparatus, for example, it is necessary to appropriately form a loop (bending) of the sheet such that printing is appropriately performed and the printed sheet is appropriately discharged from the main body of the printing apparatus.

SUMMARY

The present disclosure provides a technique advantageous in improving the quality of printing by a printing apparatus.

One of the aspects of the present disclosure provides a printing apparatus, comprising a storage unit configured to store a sheet, a printing unit configured to perform printing on the sheet conveyed from the storage unit, a first conveyance unit configured to convey the sheet toward the printing unit, a second conveyance unit provided between the first conveyance unit and the storage unit and configured to convey the sheet from the storage unit toward the first conveyance unit, a conveyance control unit configured to individually control driving of the first conveyance unit and driving of the second convey unit such that the sheet is bent between the first conveyance unit and the second conveyance unit, and a detection unit provided between the first conveyance unit and the second conveyance unit and configured to detect bending of the sheet, wherein the conveyance control unit stops conveyance of the sheet by the first conveyance unit based on a detection result of the detection unit.

Further features of the present disclosure will become apparent from the following description of exemplary embodiments (with reference to the attached drawings).

DESCRIPTION OF THE EMBODIMENTS

Figure 1:
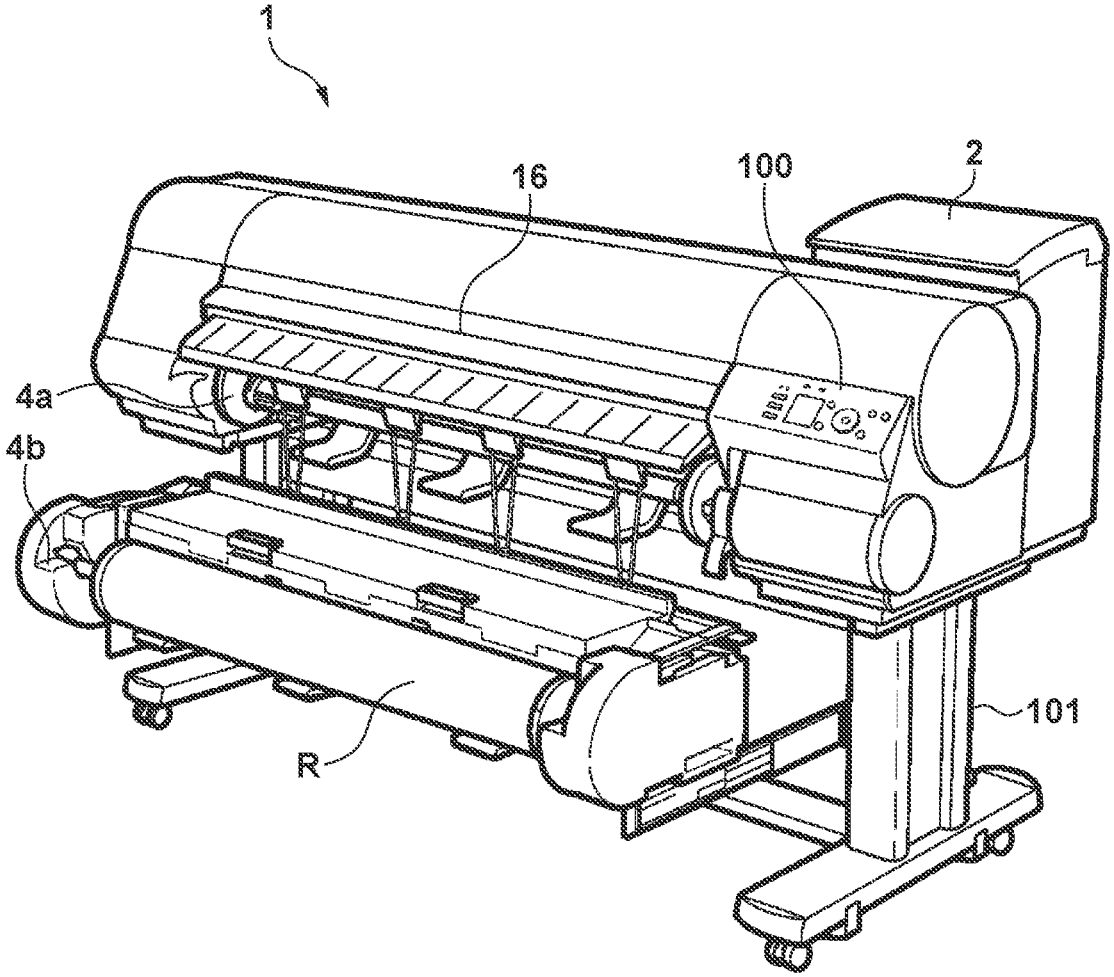
FIG. 1 is an outer perspective view of an inkjet printing apparatus.

Hereinafter, embodiments will be described in detail with reference to the attached drawings. Note, the following embodiments are not intended to limit the scope of the claimed disclosure. Multiple features are described in the embodiments, but limitation is not made that requires all such features, and multiple such features may be combined as appropriate. Furthermore, in the attached drawings, the same reference numerals are given to the same or similar configurations, and redundant description thereof is omitted.

<Outline of Printing Apparatus>

FIG. 1 is a perspective view of an inkjet printing apparatus (to be referred to as a printing apparatus hereinafter) 1 according an aspect of an embodiment. An operation panel 100 used to perform various types of settings regarding printing or display the state of the apparatus is arranged in the printing apparatus 1. The operation panel 100 may be a touch panel display, may be an operation board where press switches or the like are arrayed, or may additionally incorporate a sound source for sounding a predetermined notification sound.

The main body of the printing apparatus 1 is supported by a stand 101. A printing unit (to be described later) configured to perform printing is incorporated in the main body of the printing apparatus 1 and sealed by an openable/closable cover 16. Although the details will be described later, a line type printhead (which can be also referred to as a line head or the like) that has a print width corresponding to the width of a print medium and prints an image by discharging ink (ink droplets) onto the print medium is used as the printing unit described above.

Further, the main body of the printing apparatus 1 incorporates an ink tank that stores ink, and is provided with an ink tank cover 2 that seals the ink tank. When replacement of the ink tank is required, it is possible to access the ink tank by operating the ink tank cover 2.

The printing unit described above is formed from a plurality of printheads, for example, four printheads corresponding to cyan (C), magenta (M), yellow (Y), and black (K), which have similar arrangements. That is, four ink tanks storing inks of four colors C, M, Y, and K, respectively, are stored inside the ink tank cover 2. Note that these ink tanks can be replaced independently of each other.

A sheet (to be referred to as a roll sheet hereinafter) obtained by winding a long sheet having a sheet width (for example, a width of 10 inches to 40 inches) corresponding to the printing width of the above-described printing unit into a roll form is mounted as a print medium in the printing apparatus 1. By performing printing based on image data by the above-described printing unit while conveying the print medium to a printing region of the printing unit, a desired image can be formed on the print medium. Note that the concept of "images" includes characters, signs, graphics, photographs, and the like, and also includes blanks that can be formed therebetween.

As shown in FIG. 1, the roll sheet can be stored (housed or attached) in each of an upper storage unit 4*a* and a lower storage unit 4*b*, and printing can be performed on the roll sheet by conveying the roll sheet from one of the storage units. Each of the storage units 4*a* and 4*b* can be expressed as a housing unit, attachment unit, or the like. FIG. 1 shows, as an example, a state in which a roll sheet R is attached to the lower storage unit 4*b*.

<Arrangement Example of Printing Unit>

Figure 2:
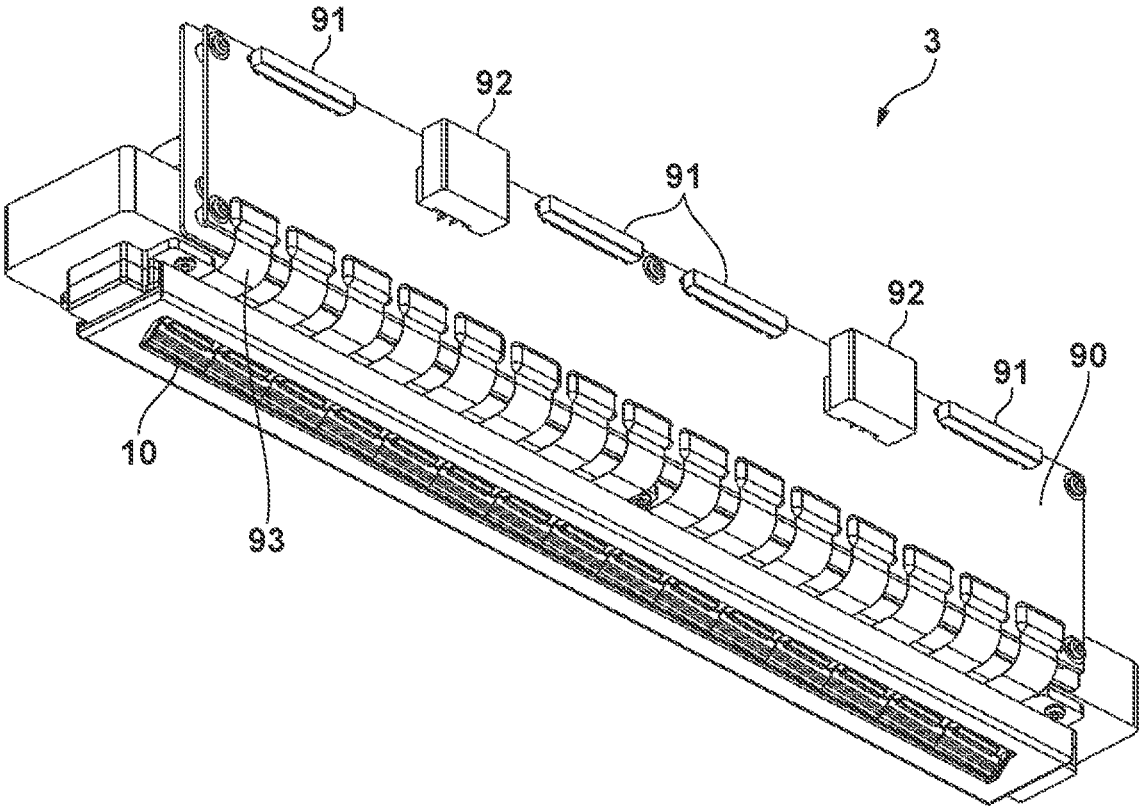
FIG. 2 is a perspective view showing an arrangement example of a printhead.

FIG. 2 is a perspective view showing the arrangement of the above-described printing unit (to be referred to as a printing unit 3). The printing unit 3 is a line type printhead in which 15 element boards 10 capable of discharging inks of four colors C, M, Y, and K are arrayed in a straight line (arranged in-line). As another embodiment, the printing unit 3 may be configured to discharge inks of the above-described four colors by arranging, in a conveyance direction of a print medium, four printheads each configured to be capable of discharging an ink of one color.

In addition to the above-described element boards 10, the printing unit 3 further includes flexible wiring boards 93, an electrical wiring board 90, and signal input terminals 91 and power supply terminals 92 electrically connected via the flexible wiring boards 40 and the electrical wiring board 90. The signal input terminals 91 and the power supply terminals 92 are electrically connected to respective control units (to be described later) of the printing apparatus 1, and supply discharge driving signals and power required for discharge, respectively, to the element boards 10. By consolidating the wirings by the electric circuit in the electric wiring board 90, the number of the signal output terminals 91 and the number of the power supply terminals 92 can be reduced as compared with the number of the element boards 10. With this arrangement, it is possible to reduce the number of electrical connection portions that need to be disconnected when the printing unit 3 is attached to the printing apparatus 1 or when the printing unit 3 is replaced.

An electrothermal transducer (heater) (not shown) is provided on the element board 10 so as to correspond to each discharge port (nozzle). When each electrothermal transducer is energized, the ink is heated and bubbles, and the ink is discharged from the discharge port by the foaming energy.

Note that the line type printhead has been exemplified as the printing unit, but a serial printhead may be used, or a method different from the inkjet method may be employed.

<Example of System Configuration of Printing Apparatus>

Figure 3:
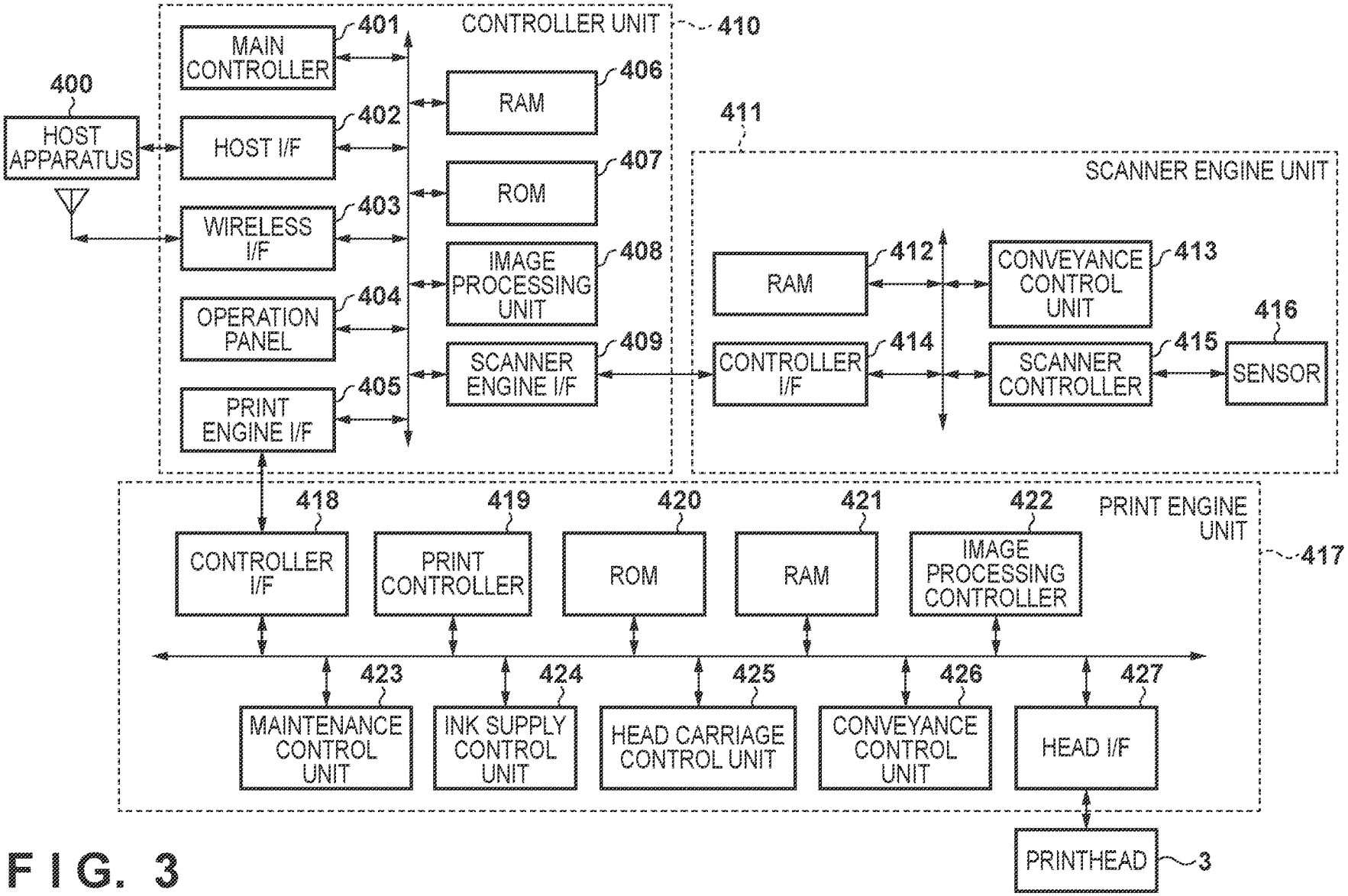
FIG. 3 is a block diagram showing an arrangement example of the printing apparatus.

FIG. 3 is a block diagram showing the arrangement of a control circuit of the printing apparatus 1. The printing apparatus 1 includes a print engine unit 417 that comprehensively controls driving of the printing unit 3, a scanner engine unit 411 that comprehensively controls driving of a scanner unit, and a controller unit 410 that comprehensively controls driving of the overall printing apparatus 1.

The print engine unit 417 includes a print controller 419, a ROM (Read-Only Memory) 420, a RAM (Random Access Memory) 421, a controller I/F (interface) 418, an image processing controller 422, a head I/F 427, a conveyance control unit 426, a head carriage control unit 425, an ink supply control unit 424, and a maintenance control unit 423.

The scanner engine unit 411 includes a scanner controller 415, a controller I/F 414, a conveyance control unit 413, a sensor 416, and a RAM 412.

The controller unit 410 includes a main controller 401, a ROM 407, a RAM 406, a host I/F 402, a wireless I/F 403, an image processing unit 408, a print engine I/F 405, an operation panel 404, and a scanner engine I/F 409.

The print controller 419 incorporates an MPU (Micro Processing Unit) or a nonvolatile memory (for example, an EEPROM or the like), and controls various types of mechanisms of the print engine unit 417 in accordance with instructions from the main controller 401 of the controller unit 410. Various types of mechanisms of the scanner engine unit 411 are controlled by the main controller 401 of the controller unit 410.

In the controller unit 410, the main controller 401 formed from a CPU controls the overall printing apparatus 1 in accordance with programs and various types of parameters stored in the ROM 407 while using the RAM 406 as a work area. For example, a print job is input from a host apparatus 400 via the host I/F 402 or the wireless I/F 403. In accordance with this, the image processing unit 408 performs, in accordance with an instruction from the main controller 401, predetermined image processing on image data included in the print job or input together with the print job. Then, the main controller 401 transmits the image data having undergone the image processing to the print engine unit 417 via the print engine I/F 405.

Note that the printing apparatus 1 may obtain image data from the host apparatus 400 via wireless communication or wired communication, or may obtain image data from an external storage device (USB memory or the like) connected to the printing apparatus 1. The communication method used for the wireless communication or wired communication is not limited. For example, Wi-Fi (Wireless Fidelity)® or Bluetooth® is applicable as the communication method used for the wireless communication. USB (Universal Serial Bus) or the like is applicable as the communication method used for the wired communication. For example, if a reading instruction is input from the host apparatus 400, the main controller 401 transmits the instruction to the scanner engine unit 411 via the scanner engine I/F 409.

The operation panel 404 is a unit used by a user to give an input/output to the printing apparatus 1, and corresponds to the operation panel 100 in FIG. 1. Via the operation panel 404, the user can instruct an operation such as a copy operation or a scan operation, set a printing mode, or recognize information of the printing apparatus 1.

In the print engine unit 417, the print controller 419 formed from a CPU controls various types of mechanisms of the print engine unit 417 in accordance with programs and various types of parameters stored in the ROM 420 while using the RAM 421 as a work area.

When various types of commands and image data are received via the controller I/F 418, the print controller 419 temporarily stores them in the RAM 421. The print controller 419 causes the image processing controller 422 to convert the above-described stored image data into print data such that the printing unit 3 can use it for a printing operation. When the print data is generated, the print controller 419 causes, via the head I/F 427, the printing unit 3 to perform a printing operation based on the print data. At this time, the print controller 419 drives each conveyance unit (to be described later) via the conveyance control unit 426 to convey the roll sheet serving as a print medium. When the printing unit 3 performs the printing operation in synchronization with the conveyance operation in accordance with an instruction from the print controller 419, print processing is performed on the roll sheet.

The head carriage control unit 425 changes the orientation and position of the printing unit 3 in accordance with the operation state of the printing apparatus 1 such as a maintenance state or a printing state. The ink supply control unit 424 controls a liquid supply unit (not shown) such that the pressure of the ink supplied to the printing unit 3 falls within an appropriate range. The maintenance control unit 423 controls operations of a cap unit and a wiping unit in a maintenance unit (not shown) upon performing a maintenance operation of the printing unit 3.

In the scanner engine unit 411, the main controller 401 controls the hardware resource of the scanner controller 415 in accordance with programs and various types of parameters stored in the ROM 407 while using the RAM 406 as a work area. With this operation, various kinds of mechanisms included in the scanner engine unit 411 are controlled. For example, the main controller 401 controls, via the controller I/F 414, the hardware resource in the scanner controller 415 to cause the conveyance control unit 413 to convey a document stacked on an ADF (Auto Document Feeder) (not shown) by a user, and read the document by the sensor 416. Then, the scanner controller 415 stores the read image data in the RAM 412.

Note that by converting the image data obtained as described above into print data, the print controller 419 can cause the printing unit 3 to perform a printing operation based on the image data read by the scanner controller 415.

<Arrangement Example of Conveyance Mechanism of Printing Apparatus>

Figure 4:
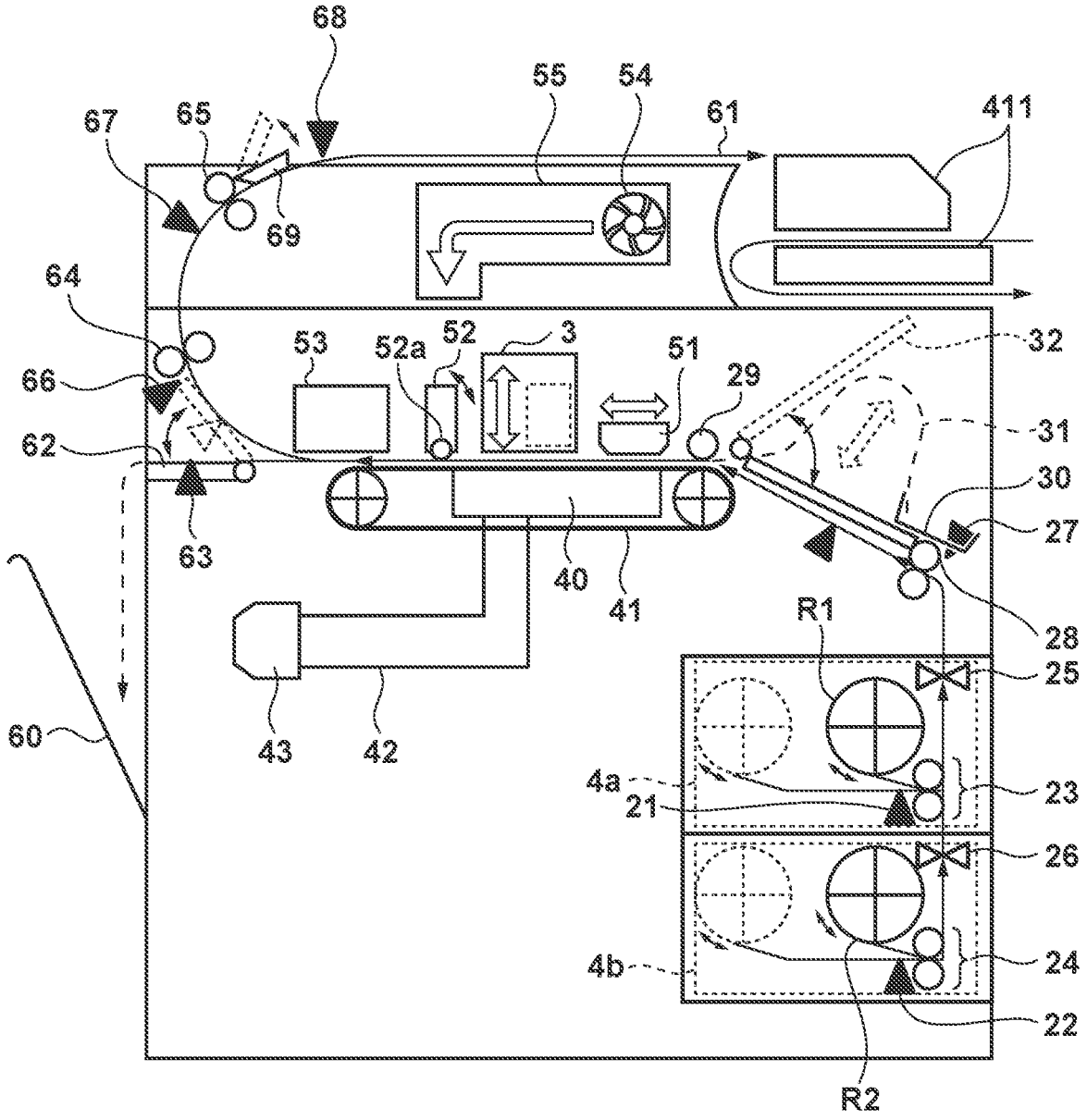
FIG. 4 is a schematic side view showing the internal arrangement of the printing apparatus.

FIG. 4 is a schematic side view of the printing apparatus 1, and shows main components forming a roll sheet conveyance mechanism. A roll sheet R1 is loaded in the storage unit 4*a*, and a roll sheet R2 is loaded in the storage unit 4*b*. If a user loads the roll sheet R1 in a dashed line portion in the storage unit 4*a*, the roll sheet R1 rotates and moves to a shaded portion and is fixed and attached to the printing apparatus 1. Similarly, if the user loads the roll sheet R2 in a dashed line portion in the storage unit 4*b*, the roll sheet R2 rotates and moves to a shaded portion and is fixed and attached to the printing apparatus 1.

For example, when printing an image on the roll sheet R1, a feeding motor (not shown) attached to a rotation shaft of the storage unit 4*a* is driven and a leading end of the roll sheet R1 is fed out. If the leading end is detected by a feedout sensor 21, it is nipped by a feeding roller pair 23. Then, the leading end of the roll sheet R1 is further conveyed by rotation of the feeding roller pair 23, and a leading end portion of the roll sheet R1 is cut by a cutter unit 25 to trim the shape thereof. Although the details will be described later, driving of the cutter unit 25 is mainly controlled by the controller unit 410.

Similarly, when printing an image on the roll sheet R2, a feeding motor (not shown) attached to a rotation shaft of the storage unit 4*b* is driven and a leading end of the roll sheet R2 is fed out. If the leading end is detected by a feedout sensor 22, it is nipped by a feeding roller pair 24. Then, the leading end of the roll sheet R2 is further conveyed by rotation of the feeding roller pair 24, and a leading end portion of the roll sheet R2 is cut by a cutter unit 26 to trim the shape thereof. Similar to the cutter unit 25, driving of the cutter unit 26 is mainly controlled by the controller unit 410.

The roll sheet with the leading end trimmed by the cutter unit 25 or 26 is further fed out in a direction of an arrow. If the leading end is detected by a leading end detection sensor 27, respective conveyance rollers are driven and start to rotate. The roller sheet with the leading end nipped by a conveyance roller 28 is further conveyed and reaches a LF roller 29. If the leading end of the roll sheet is nipped by the LF roller 29, the roll sheet is conveyed by the LF roller 29 and the conveyance roller 28, and the roll sheet is conveyed on a conveyance belt 41. Note that a fixed guide 30 is provided near the leading end detection sensor 27 and can support smooth conveyance of the roll sheet.

At this time, if the rollers 28 and 29 are controlled such that the rotation speed (V) of the conveyance roller 28 is higher than the rotation speed (V0) of the LF roller 29, bending (to be referred to as a loop hereinafter) 31 of the roll sheet is formed as indicated by a dashed line in FIG. 4. Here, as a guide portion that guides conveyance of the roll sheet from the conveyance roller 28 to the LF roller 29, a flapper 32, configured to be displaced to change whether to form the loop 31, is provided between the conveyance roller 28 and the LF roller 29. More specifically, the flapper 32 is fixed at one end portion and can rotate with the fixed portion as the rotation axis. By rotating the flapper 32, formation of the loop 31 is not disturbed.

That is, the one end portion of the flapper 32 is axially supported as the rotation axis, and in a closed state, the flapper 32 guides conveyance of the roll sheet so as not to form the loop 31. During the conveyance, the conveyance roller 28 and the LF roller 29 are driven at rotation speeds substantially equal to each other (V=V0). Further, if the flapper 32 is rotated and displaced to an open state, it guides conveyance of the roll sheet so as to form the loop 31. During the conveyance, the conveyance roller 28 is driven at a rotation speed higher than that of the LF roller 29 (V> V0).

After the loop 31 is formed so as to satisfy a predetermined criterion, the rotation speed V of the conveyance roller 28 is set equal to the rotation speed V0 of the LF roller 29 (V=V0). With this operation, the roll sheet is further conveyed with the loop 31 maintained, and the roll sheet reaches a printing position between the lower portion of the printing unit 3 and a platen 40. Then, the printing unit 3 starts printing on the roll sheet being conveyed.

Although the details will be described later, when the roll sheet is cut by the cutter unit 25 or 26, the cutter unit 25 or 26 is driven while maintaining the rotation speed V0 of the LF roller 29 and suppressing driving of the conveyance roller 28/stopping the conveyance roller 28 (V=0). With this operation, the roll sheet is cut while the loop 31 is decreased. At this time, since driving of the conveyance roller 28 is suppressed, it is possible to match the cut surface of the roll sheet with the direction of the sheet width. In addition, since the rotation speed V0 of the LF roller 29 is maintained, it is possible to perform printing on the roll sheet by the printing unit 3 in parallel with cutting the roll sheet by the cutter unit 25 or 26.

As shown in FIG. 4, the platen 40 is provided below the conveyance belt 41 between the upstream side and the downstream side of the printing unit 3 in the conveyance direction of the roll sheet, and connected to a suction fan 43 via a duct 42. With such an arrangement, when the suction fan 43 is operated to suck the air inside the duct 42 and generate a negative pressure, the roll sheet is brought into tight contact with the conveyance belt 41 via holes provided in the platen 40 so that the roll sheet in conveyance can be prevented from floating up.

Note that in this specification, the "upstream side" and the "downstream side" indicate a relative positional relationship between two components in the roll sheet conveyance path (to be simply referred to as the conveyance path hereinafter). That is, the "downstream side" indicates a forward side in the roll sheet conveyance direction (to be simply referred to as the conveyance direction hereinafter), and the "upstream side" indicates a backward side in the conveyance direction.

Further, a recovery unit 51 is provided on the upstream side of the printing unit 3, and a cap 52 and a drying unit 53 are provided on the downstream side of the printing unit 3. As indicated by arrows in FIG. 4, the recovery unit 51 is configured to be movable in the conveyance direction, and the cap 52 is configured to be rotatable around a rotation shaft 52*a*. Furthermore, as has been described above, the printing unit 3 has a printing width corresponding to the width of the roll sheet serving as a print medium. The printing unit 3 is configured such that it is fixed during printing, and it can be moved vertically as indicated by an arrow in FIG. 4 except during a printing operation.

With such an arrangement, for example, if the discharge state of the printing unit 3 is to be recovered, the printing unit 3 is moved upward, and the recovery unit 51 is moved to a space generated by moving the printing unit 3. After that, the recovery unit 51 performs a predetermined recovery operation by wiping the ink discharge surface of the printing unit 3, sucking the discharge port thereof, or performing preliminary discharge of the printhead 3.

On the other hand, if neither a printing operation nor a recovery operation is performed, the printing unit 3 is moved upward, and the cap 52 is rotated and moved to a space (below the printing unit 3) formed by moving the printing unit 3. With this operation, the cap 52 caps the printhead 3 and prevents the ink discharge surface of the printing unit 3 from being dried.

The drying unit 53 heats the surface of the roll sheet to dry the roll sheet having undergone printing by ink discharge performed by the printing unit 3. With this operation, it can be prevented that the roll sheet wet by printing is further conveyed and the inside (particularly, the roll sheet conveyance path) of the apparatus is contaminated with the ink. Further, a fan 54 and a duct 55 are provided above the printing unit 3, and the outside air is sent in a direction of an arrow via the duct 55 by operating the fan 54 to promote drying of the printed roll sheet.

A printing length (L) of the roll sheet in the conveyance direction is determined by a user instruction from the operation panel 100 or an instruction from the host apparatus 400, and the roll sheet is cut at a position corresponding to the printing length L. That is, after the roll sheet with the leading end trimmed by the cutter unit 25 or 26 is conveyed by an amount corresponding to the printing length L from the leading end, a trailing end thereof is cut by the cutter unit 25 or 26.

As has been described above, while the cutter unit 25 or 26 cuts the roll sheet, the rotation speed V0 of the LF roller 29 is maintained but driving of the conveyance roller 28 is suppressed/the conveyance roller 28 is stopped (V=0). With this operation, the roll sheet is cut while the loop 31 is decreased, and it is possible to match the cut surface of the roll sheet with the direction of the sheet width. In addition, since the rotation speed V0 of the LF roller 29 is maintained, while the loop 31 is decreased, printing on the roll sheet by the printing unit 3 can be appropriately continued.

After the trailing end of the roll sheet having undergone printing by the printing unit 3 is cut by the cutter unit 25 or 26 (the cut portion will be referred to as a cut sheet hereinafter), the cut sheet is discharged to a back basket 60 or a front stacker 61. Selection of the discharge position of the cut sheet (as to whether the cut sheet is discharged to the back basket 60 or the front stacker 61) is performed by a user instruction from the operation panel 100 or an instruction from the host apparatus 400.

If the cut sheet is discharged to the back basket 60, a flapper 62 is rotated to form the conveyance path in a direction to the back basket 60. With this operation, the cut sheet is conveyed by rotation of the conveyance belt 41 and, as indicated by a dashed line in FIG. 4, falls to the back basket 60. Note that detection of the leading end of the cut sheet, detection of passage of the cut sheet, and detection of the trailing of the cut sheet end are performed using output signals from a sheet sensor 63.

If the cut sheet is discharged to the front stacker 61, the flapper 62 is rotated and moved to a position indicated by dotted lines to form the conveyance path in a direction to the front stacker 61. With this operation, the cut sheet is conveyed by rotation of the conveyance belt 41, reaches a discharge roller pair 64, further reaches a discharge roller pair 65, and is eventually discharged to the front stacker 61. Note that sheet sensors 66 and 67 and a discharge sensor 68 are provided in the conveyance path to the front stacker 61 to detect the discharge status of the cut sheet. In addition, a trailing end holding lever 69 is provided between the discharge roller pair 65 and the discharge sensor 68 to prevent the trailing end of the cut sheet from bouncing, so that smooth discharge of the cut sheet can be supported.

Note that, although a detailed description is omitted, if a user inserts an image document to the scanner engine unit 411 in a direction of a solid arrow, an image thereof can be read.

Each component such as the above-described sensor 21 used to detect a predetermined target may be simply referred to as a detection unit, or may be expressed as a first detection unit, a second detection unit, or the like to discriminate it from others. Further, each component such as the roller pair 23 used to convey a print medium (roll sheet or cut sheet) may be simply referred to as a conveyance unit, or may be expressed as a first conveyance unit, a second conveyance unit, or the like to discriminate it from others. In a following description, a roll sheet and a cut sheet are simply referred to as a sheet when discrimination between them is not particularly needed. These expressions also apply to contents to be described below.

First Embodiment

Figure 5A:
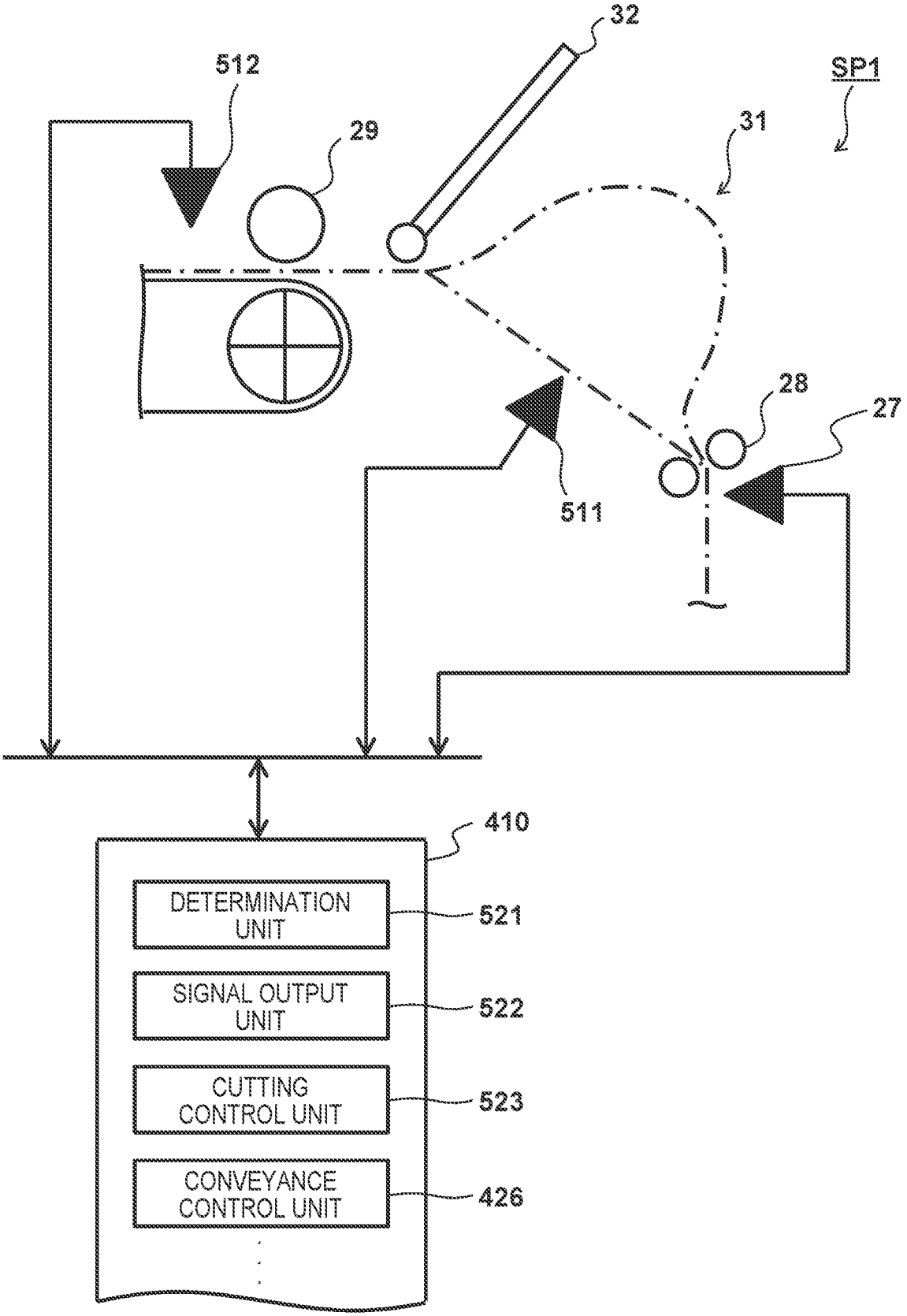
FIG. 5A is a schematic enlarged view showing a part of the internal arrangement of the printing apparatus.
Figure 5B:
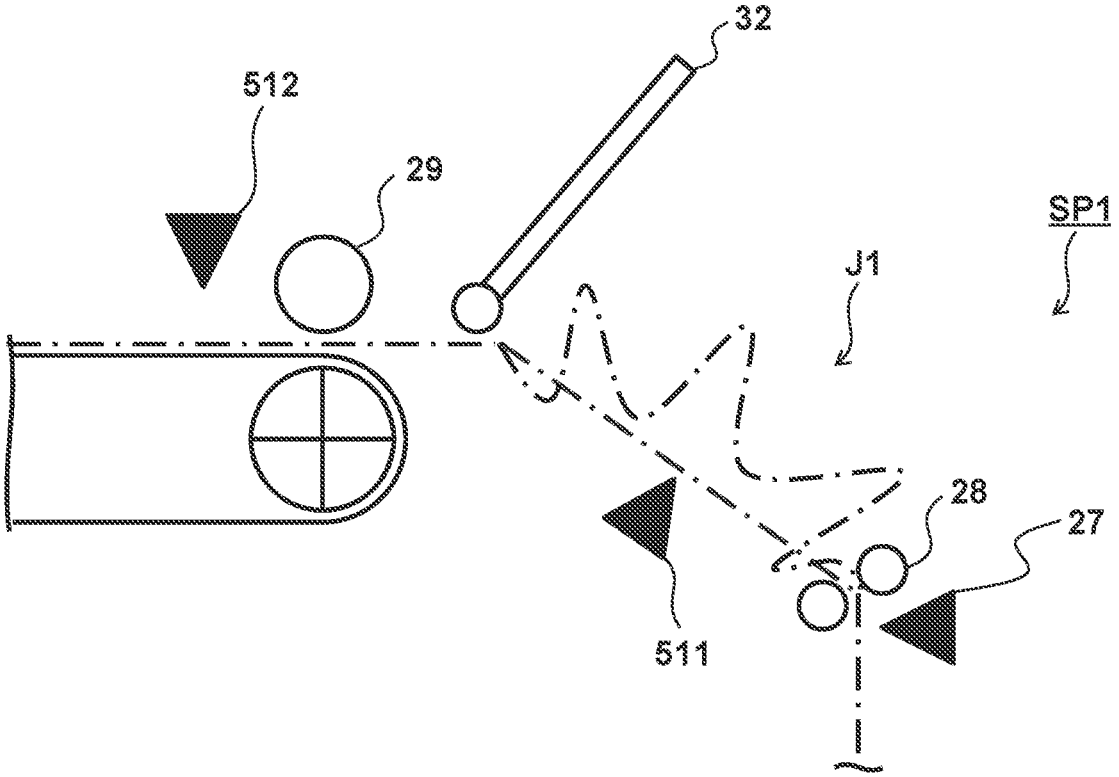
FIG. 5B is a schematic enlarged view showing the part of the internal arrangement of the printing apparatus.
Figure 5C:
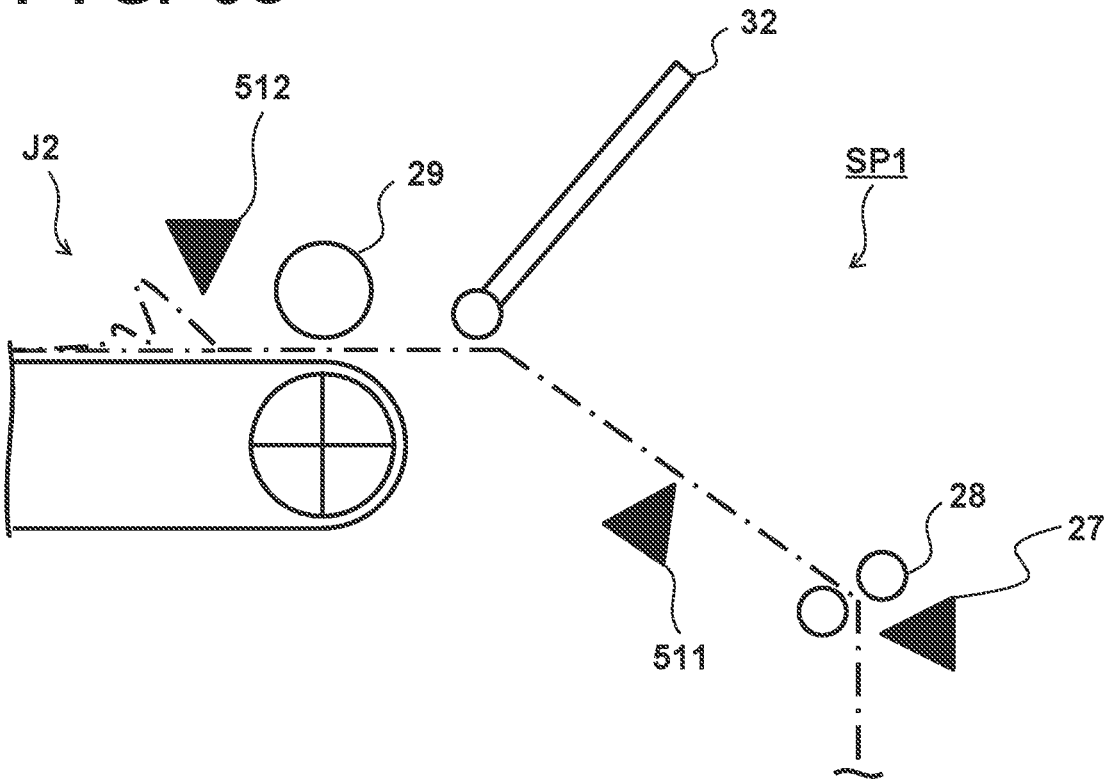
FIG. 5C is a schematic enlarged view showing the part of the internal arrangement of the printing apparatus.

FIGS. 5A to 5C are enlarged schematic views each showing a space (to be referred to as a space SP1) in which a loop 31 is to be formed and the arrangement of a printing apparatus 1 in a region around the space SP1. Here, a flapper 32 is set in an open state such that the loop 31 can be formed. In each drawing, a roll sheet is indicated by an alternate long dash and dot line.

The printing apparatus 1 further includes a loop sensor 511 and a flatness sensor 512. The loop sensor 511 is arranged between the conveyance roller 28 and the LF roller 29 in a conveyance path, and can detect the presence/absence and mode of the loop 31. The flatness sensor 512 is arranged on the downstream side of the LF roller 29, and can detect the flatness of the sheet on the conveyance belt 41. The flatness sensor 512 is a known sensor that can measure the distance to the sheet and/or detect the distribution of the distance over a predetermined range. The loop sensor 511 and the flatness sensor 512 are, for example, an optical sensor, an infrared sensor, or the like.

The controller unit 410 further includes a determination unit 521, a signal output unit 522, and a cutting control unit 523. Although the details will be described later, the determination unit 521 determines, based on a detection result of the loop sensor 511 and a detection result of the flatness sensor 512, whether the loop 31 has been appropriately formed. The signal output unit 522 outputs a predetermined signal based on a determination result of the determination unit 521. The cutting control unit 523 controls driving of the cutter unit 25 or 26 based on a signal from the signal output unit 522.

FIG. 5A shows a case in which the loop 31 is appropriately formed between the conveyance roller 28 and the LF roller 29, and no jam (wrinkles that can be generated in the sheet or a paper jam in a case of paper) has occurred downstream of the LF roller 29. In this case, based on that the distance to the roll sheet in a detection range is larger than a reference value, the loop sensor 511 outputs a signal (for example, a signal with a signal value of 1) indicating that the mode of the loop 31 satisfies a criterion. In addition, based on that the variation in distance to the roll sheet in a detection range falls within an allowable range, the flatness sensor 512 outputs a signal (for example, a signal having a signal value of 1) indicating that no jam has occurred.

FIG. 5B shows a case in which the loop 31 is inappropriately formed between the conveyance roller 28 and the LF roller 29 and a jam (indicated by reference symbol J1 in FIG. 5B) has occurred. In this case, based on that the roll sheet in the detection range includes a portion where the distance between the loop sensor 511 and the roll sheet is smaller than the reference value, the loop sensor 511 outputs a signal (for example, a signal having a signal value of 0) indicating that the mode of the loop 31 does not satisfy the criterion. Note that in FIG. 5B, the flatness sensor 512 outputs a signal (for example, a signal having a signal value of 1) indicating that no jam has occurred.

FIG. 5C shows a case in which the loop 31 is inappropriately formed between the conveyance roller 28 and the LF roller 29 and a jam (indicated by reference symbol J2 in FIG. 5C) has occurred downstream of the LF roller 29. In this case, based on that the roll sheet in the detection range includes a portion where the distance between the loop sensor 511 and the roll sheet is smaller than the reference value, the loop sensor 511 outputs a signal (for example, a signal having a signal value of 0) indicating that the mode of the loop 31 does not satisfy the criterion. In addition, based on that the variation in distance to the roll sheet in the detection range falls outside an allowable range, the flatness sensor 512 outputs a signal (for example, a signal having a signal value of 0) indicating that a jam has occurred.

The determination unit 521 receives signals indicating the detection results from the loop sensor 511 and the flatness sensor 512, and determines, based on the signals, the status of the roll sheet in conveyance among the statuses descried in FIGS. 5A to 5C. Based on the determination result of the determination unit 521, the signal output unit 522 outputs a signal corresponding to the determination result.

For example, in the case shown in FIG. 5A, the signal output unit 522 outputs a signal instructing the conveyance control unit 426 to continue the conveyance of the roll sheet by the rollers 28 and 29 and instructing the cutting control unit 523 to cut the roll sheet by the cutter unit 25 or 26. Since the roll sheet is appropriately conveyed, the printing unit 3 performs printing on the roll sheet.

For example, in the case shown in FIG. 5B, the signal output unit 522 outputs a signal instructing the conveyance control unit 426 to interrupt the conveyance of the roll sheet by the rollers 28 and 29 and instructs the cutting control unit 523 not to cut the roll sheet by the cutter unit 25 or 26. Since the roll sheet is inappropriately conveyed, printing on the roll sheet is also interrupted, and information indicating the interruption is notified to a user by a predetermined notification unit (in this embodiment, this is performed by displaying the information on an operation panel 100).

For example, in the case shown in FIG. 5C the signal output unit 522 outputs a signal instructing the cutting control unit 523 to cut the roll sheet by the cutter unit 25 or 26. The cut sheet left on the conveyance path by the cutting may be manually removed by the user, or may be conveyed and discharged by the rollers 28 and 29 driven by the conveyance control unit 426 based on the signal from the signal output unit 522. As in the case shown in FIG. 5B, since the cut sheet is inappropriately conveyed, printing on the cut sheet is interrupted, and information indicating the interruption can be displayed on the operation panel 100 and notified to the user.

Figure 6:
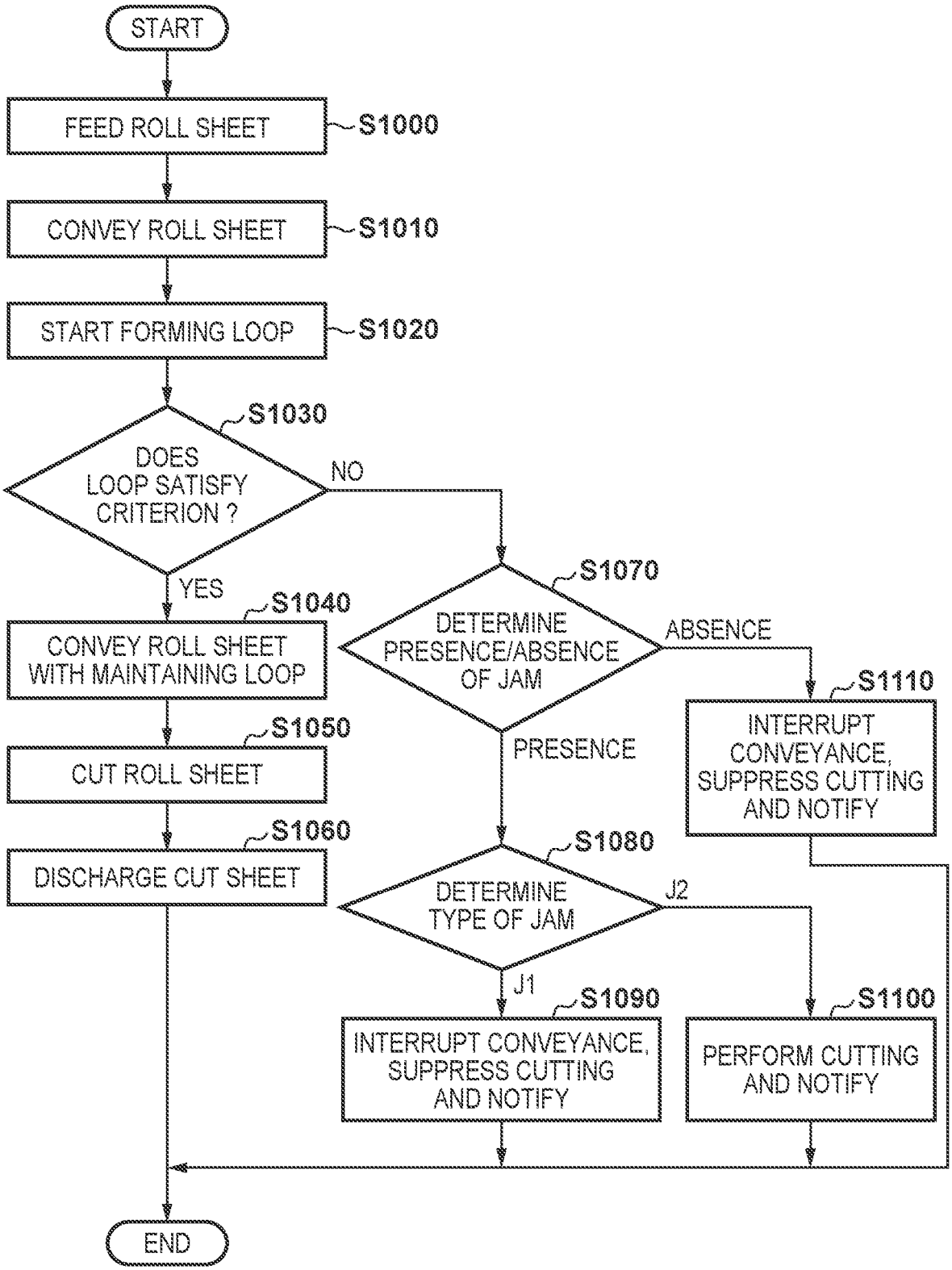
FIG. 6 is a flowchart illustrating a control method of the printing apparatus.

FIG. 6 is a flowchart illustrating a control method of the printing apparatus 1 based on the presence/absence and mode of the loop 31. This flowchart is mainly executed by the controller unit 410 in accordance with input of a print job. The outline of the flowchart is that the conveyance control unit 426 controls driving of the rollers 28 and 29 based on the status of the roll sheet in conveyance among the statuses described in FIGS. 5A and 5C, and the cutting control unit 523 controls driving of the cutter unit 25 or 26. Note that during execution of the flowchart, the printing unit 3 can appropriately perform printing, but a description thereof will be omitted in the following description.

In step S1000 (to be simply referred as "S1000" hereinafter, and the same applies to the other steps to be described later), based on the print job, a roll sheet R1 (or R2) is fed out from a storage unit 4*a* (or 4*b*) to the conveyance roller 28 by a roller pair 23 (or 24). A leading end detection sensor 27 can detect that the roll sheet has reached the conveyance roller 28. In accordance with the roll sheet reaching the conveyance roller 28, the process advances to S1010.

In S1010, the roll sheet is conveyed to the LF roller 29 while maintaining the flapper 32 in the closed state. The leading end detection sensor 27, the loop sensor 511 and/or the flatness sensor 512 can detect that the roll sheet has reached the LF roller 29. For example, if the loop sensor 511 is located in the central part between the rollers 28 and 29, the timing at which the roll sheet reaches the LF roller 29 can be appropriately calculated based on a difference between a timing of detecting the roll sheet by the leading end detection sensor 27 and a timing of detecting the roll sheet by the loop sensor 511. Further, since the flatness sensor 512 is arranged downstream of the LF roller 29, it can detect that the roll sheet has reached the LF roller sheet 29. Note that in this stage, the rollers 28 and 29 are driven at rotation speeds equal to each other (V=V0).

In accordance with the roll sheet reaching the LF roller 29, the process advances to S1020.

In S1020, formation of the loop 31 is started. As has been described, this is implemented by rotating the flapper 32 to set it in the open state and then driving the conveyance roller 28 at a rotation speed higher than that of the LF roller 29 (V>V0). After a predetermined time has elapsed since the formation of the loop 31 is started, the process advances to S1030.

In S1030, it is determined whether the loop 31 formed in S1020 satisfies the criterion. As has been described above, this determination is performed based on a detection result of the loop sensor 511. If it is determined that the loop 31 satisfies the criterion, the process advances to S1040; otherwise, the process advances to S1070.

In S1040, in accordance with the determination made in S1030 that the loop 31 satisfies the criterion, the roll sheet is further conveyed by the rollers 28 and 29 while maintaining the loop 31 formed in S1020. As has been described above, this can be implemented by setting the rotation speed V of the conveyance roller 28 equal to the rotation speed V0 of the LF roller 29 (V=V0). After that, in accordance with conveyance of the roll sheet by an amount corresponding to a printing length L from the leading end, the process advances to S1050.

In S1050, the roll sheet is cut by the cutter unit 25 (or 26). As has been described above, this is performed while maintaining the rotation speed V0 of the LF roller 29 and suppressing driving of the conveyance roller 28/stopping the conveyance roller 28 (V=0) (while the loop 31 is decreased). After the roll sheet is cut, the process advances to S1060.

In S1060, the cut sheet obtained in S1050 is conveyed by the LF roller 29 and discharged from the main body of the printing apparatus 1.

In S1070, in accordance with the determination made in S1030 that the loop 31 does not satisfy the criterion, the presence/absence of a jam is determined. As has been described above, this determination is performed by the determination unit 521 based on detection results of the loop sensor 511 and the flatness sensor 512 (see FIGS. 5B and 5C). For the sake of descriptive convenience, it is assumed here that either of a jam in the case shown in FIG. 5B or a jam in the case shown in FIG. 5C occurs. If it is determined that a jam has occurred, the process advances to S1080. If it is determined that no jam has occurred, the process advances to S1110.

In S1080, in accordance with the determination made in S1030 that the loop 31 does not satisfy the criterion and the determination made in S1070 that a jam has occurred, the determination unit 521 determines the type of the jam. If the type of the jam is that (jam J1) shown in FIG. 5B, the process advances to S1090, and if the type of the jam is that (jam J2) shown in FIG. 5C, the process advances to S1100.

In S1090, in accordance with the determination made in S1080 that the jam J1 described in FIG. 5B has occurred, the conveyance of the roll sheet by the rollers 28 and 29 is interrupted and the roll sheet is not cut by the cutter unit 25 or 26. Additionally, it is notified to the user using the operation panel 100 that the jam J1 has occurred. Further, it can be additionally notified to the user that the roll sheet left on the conveyance path should be manually removed by the user.

In S1100, in accordance with the determination made in S1080 that the jam J2 described in FIG. 5C has occurred, the roll sheet is cut by the cutter unit 25 or 26. Additionally, it is notified to the user using the operation panel 100 that the jam J2 has occurred. Further, it can be additionally notified to the user that the cut sheet left on the conveyance path by the cutting should be manually removed by the user, or the cut sheet can be conveyed and discharged by the rollers 28 and 29.

In S1110, in accordance with the determination made in S1070 that no jam has occurred despite the determination made in S1030 that the loop 31 does not satisfy the criterion, control similar to that in S1090 is performed in this embodiment. That is, here, the conveyance of the roll sheet by the rollers 28 and 29 is interrupted and the roll sheet is not cut by the cutter unit 25 or 26. Note that as another embodiment, by further determining individually and specifically the event that has occurred on the roll sheet (for example, a case in which both the jams J1 and J2 have occurred at the same time), another control may be performed.

As has been described above, according to this embodiment, the conveyance control unit 426 individually controls driving of the roller 28 and driving of the roller 29 such that the loop 31 is formed (such that the sheet bends) between the LF roller 29 (first conveyance unit) and the conveyance roller 28 (second conveyance unit). Then, it is detected by the loop sensor 511 (detection unit) whether the loop 31 satisfies the criterion, and the signal output unit 522 outputs a predetermined signal, based on the detection result. For example, if the signal from the signal output unit 522 indicates that the loop 31 is not appropriately formed, the cut control unit 523 suppresses driving of the cutter units 25 and 26 in the first embodiment. With this operation, it is possible to prevent that the sheet is cut in an unintentional mode, the cutter units 25 and 26 are damaged accordingly, the sheet is used uselessly, and the like.

For example, if a first signal (e.g., an enable signal) indicating that the loop 31 satisfies the criterion is output by the signal output unit 522, the conveyance control unit 426 suppresses driving of the conveyance roller 28 while maintaining driving of the LF roller 29. Then, during this operation, the cutting control unit 523 drives the cutter unit 25 or 26. On the other hand, if a second signal (for example, a disable signal) indicating that the loop 31 does not satisfies the criterion is output by the signal output unit 522, the conveyance control unit 426 suppresses driving of the roller 28 and driving of the roller 29. Then, the cutting control unit 523 suppresses driving of the cutter unit 25 and 26.

Additionally, in this embodiment, the determination unit 521 can determine the presence/absence and mode of the jam based on the detection result of the flatness sensor 512. Based on the determination result, the conveyance control unit 426 determines whether to drive the rollers 28 and 29, and the cutting control unit 523 determines whether to drive the cutter units 25 and 26. With this operation, based on whether the sheet is appropriately conveyed and the mode of the sheet, it is possible to continue the conveyance of the sheet, interrupt the conveyance and/or cut and discharge the sheet, or perform no cutting. Note that if only the determination for the loop 31 is performed (if the determination for a jam is omitted), the flatness sensor 512 may not be provided.

Second Embodiment

In the first embodiment described above, it has been described that the loop sensor 511 detects whether the loop 31 is appropriately formed. In the first embodiment, based on a detection result of the loop sensor 511, the conveyance control unit 426 controls driving of the roller 28 and driving of the roller 29 and/or the cutting control unit 523 controls driving of the cutter units 25 and 26. However, the application of the loop sensor 511 is not limited to this.

For example, the loop sensor 511 that can measure the distance to the sheet and/or detect the distribution of the distance over a predetermined range is used in the first embodiment. However, in another application, a simpler sensor can be used. In the second embodiment described below, a sheet sensor (to be referred to as a sheet sensor for discrimination) that can detect the presence/absence of a roll sheet is used as the loop sensor 511, and a loop 31 can be appropriately formed even by using such a sensor.

Figure 7:
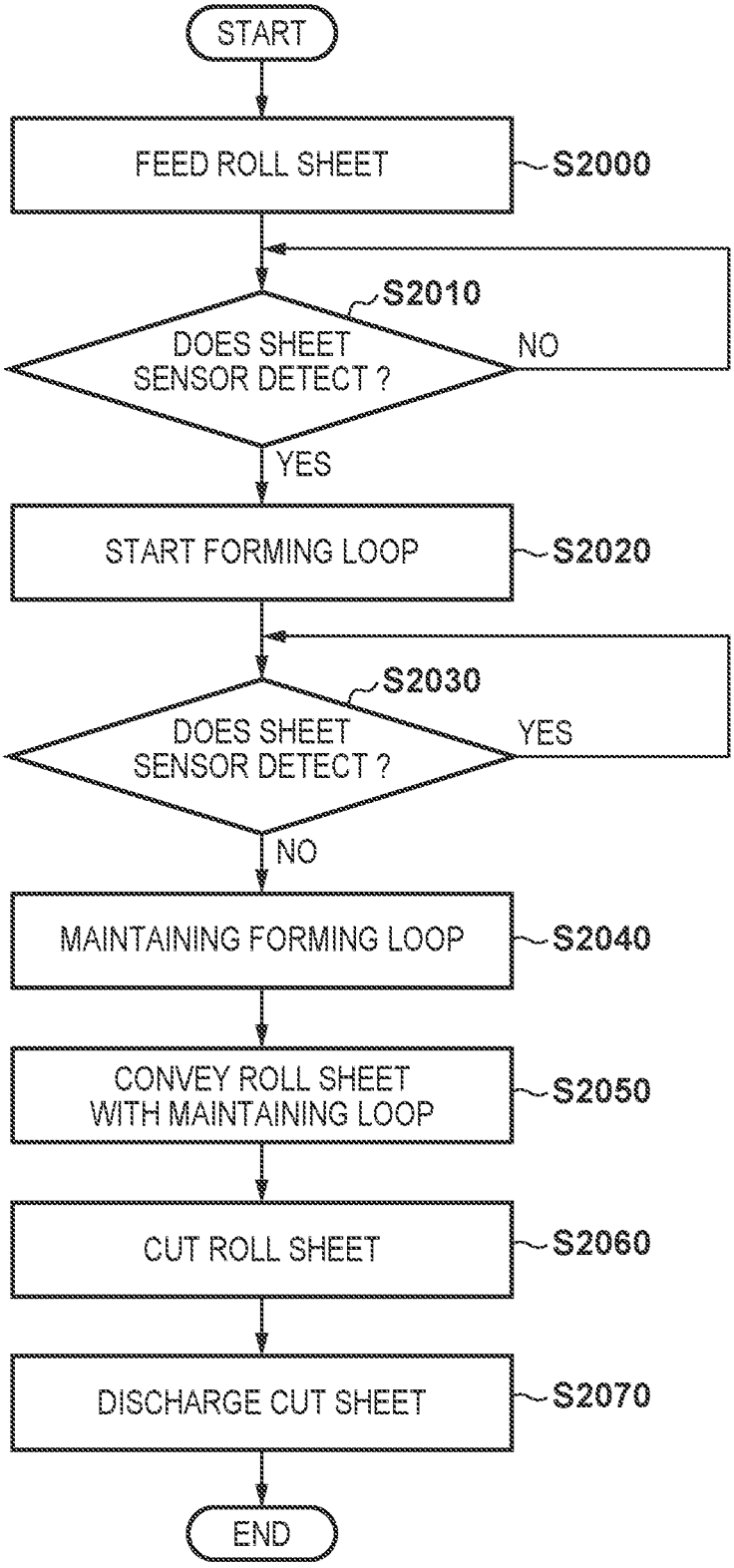
FIG. 7 is a flowchart illustrating another control method of the printing apparatus.

FIG. 7 is a flowchart illustrating a control method of a printing apparatus 1 according to the second embodiment. This flowchart is mainly executed by a controller unit 410 in accordance with input of a print job. The outline of the flowchart is that based on a detection result of the sheet sensor 511, the flapper 32 is displaced from a closed state to an open state and formation of the loop 31 is started, and driving mode of the conveyance roller 28 is additionally changed. Note that during execution of the flowchart, a printing unit 3 can appropriately perform printing, but a description thereof will be omitted in the following description.

As in S1000 (see FIG. 6), in S2000, based on the print job, a roll sheet R1 (or R2) is fed out from a storage unit 4*a* (or 4*b*) to the conveyance roller 28 by a roller pair 23 (or 24). After reaching the conveyance roller 28, the roll sheet is guided by the flapper 32 in the closed state and conveyed toward the LF roller 29.

In S2010, it is determined whether the above-described conveyed roll sheet has passed the sheet sensor 511. As has been described above, since the sheet sensor 511 can detect the presence/absence of the roll sheet, this determination is performed based on a detection result of the sheet sensor 511. If it is determined that the roll sheet has passed the sheet sensor 511, the process advances to S2020; otherwise, the process returns to S2010.

In S2020, formation of the loop 31 is started. This is implemented by driving the conveyance roller 28 at a rotation speed higher than that of the LF roller 29 (V>V0) while displacing the flapper 32 from the closed state to the open state. In order to discriminate it from other rotation speeds to be described below, the rotation speed V of the conveyance roller 28 at this time is referred to as a first rotation speed (V1) (that is, V=V1).

In S2030, it is determined whether formation of the loop 31 has been appropriately started. As has been described above, since the sheet sensor 511 can detect the presence/absence of the roll sheet, this determination is performed based on a detection result of the sheet sensor 511. More specifically, this determination is performed based on whether the roll sheet guided by the flapper 32 in the closed state in S2000 and having passed the sheet sensor 511 in S2010 is separated from the sheet sensor 511. If it is determined that formation of the loop 31 has been appropriately started, the process advances to S2040; otherwise, the process returns to S2030.

In S2040, in accordance with the determination that formation of the loop 31 has been appropriately started, the formation of the loop 31 is continued, that is, driving of the roller 28 and driving of the roller 29 are continued such that the loop 31 is formed in a desired mode (for example, a desired size is formed in a predetermined time). In this embodiment, the rotation speed V1 of the roller 28 and the rotation speed V0 of the roller 29 are maintained over a predetermined time, but the driving mode of the conveyance roller 28 may be additionally changed, for example, the rotation speed V may be changed to another rotation speed (Vx) (note that Vx>V0).

In S2050, the formation of the loop 31 is completed, and the conveyance of the roll sheet is continued while maintaining the loop 31. As has been described above, this can be implemented by setting the rotation speed V of the conveyance roller 28 equal to the rotation speed V0 of the LF roller 29 (V=V0). After that, in accordance with conveyance of the roll sheet by an amount corresponding to a printing length L from the leading end, the process advances to S2060.

Thereafter, in S2060, as in S1050 (see FIG. 6), the roll sheet is cut by the cutter unit 25 (or 26). As has been described above, this is performed while maintaining the rotation speed V0 of the LF roller 29 and suppressing driving of the conveyance roller 28/stopping the conveyance roller 28 (V=0). After the roll sheet is cut, in S2070, as in S1060 (see FIG. 6), the cut sheet obtained in S2060 is conveyed by the LF roller 29 and discharged from the main body of the printing apparatus 1.

According to this flowchart, although the relatively simple sheet sensor 511 is used, the loop 31 can be appropriately formed. The application of the sheet sensor 511 is not limited to the above-described example, and the contents of this flowchart may be changed without departing from the scope thereof.

For example, in S2040, the driving force and/or driving time of the conveyance roller 28 may be changed. This is performed by calculating the conveyance amount error in the conveyance roller 28. In S2000 to S2010, the conveyance roller 28 is driven at the rotation speed equal to the rotation speed V0 of the LF roller 29 (V=V0). However, a conveyance slip of the roll sheet can occur in the conveyance roller 28, and this leads to a conveyance amount error in the conveyance roller 28. This can also prevent formation of the loop 31 in a desired mode.

Here, a distance (D) between a leading end detection sensor 27 and the sheet sensor 511 can be specified in advance. Therefore, it is possible to calculate the difference between the theoretical value and measured value of the conveyance amount by the conveyance roller 28 based on a difference between a timing of detecting the roll sheet by the sensor 27 and a timing of detecting the roll sheet by the sensor 511, and based on the calculation result, an effective value (V0*a*) of the rotation speed of the conveyance roller 28 can be calculated. That is, the degree of the above-described conveyance slip (conveyance amount error) can be equivalently converted into the effective value V0*a* of the rotation speed of the conveyance roller 28.

For example, let T1 be the timing of detecting the roll sheet by the leading end detection sensor 27, and let T2 be the timing of detecting the roll sheet by the sheet sensor 511. Using the distance D between the sensors 27 and 511, the degree of the above-described conveyance slip can be evaluated as an evaluation value E (=V0*a*/V0) expressed by:

$$E=\{D/(T2-T1)\}/V0$$

Based on the evaluation value E, in S2040, it is possible to change or adjust the driving mode of the conveyance roller 28, for example, the driving force of the conveyance roller 28 can be changed and/or the driving time of the conveyance roller 28 can be changed.

As has been described above, according to this embodiment, when the loop 31 is formed (the sheet is bent) between the LF roller 29 (first conveyance unit) and the conveyance roller 28 (second conveyance unit), a conveyance control unit 426 controls driving of each component based on a signal from a signal output unit 522. Further, after formation of the loop 31 is started, it is also possible to additionally change the driving mode of the conveyance roller 28. Examples of changing the driving mode of the conveyance roller 28 are changing the driving force of the conveyance roller 28, changing the driving time of the conveyance roller 28, and the like. With this operation, it is possible to form the loop 31 in a desired mode.

In this embodiment, the sheet sensor 511 (first detection unit) can detect passage of the sheet, and the leading end detection sensor 27 (second detection unit) can detect that the sheet conveyed from the storage unit 4*a*/4*b* has reached the conveyance roller 28. In such an arrangement, while the flapper 32 (guide portion) is in the closed state (a state in which formation of the loop 31 is not allowed), the conveyance control unit 426 calculates, based on the difference between the detection time in the sensor 27 and the detection time in the sensor 511, the sheet conveyance amount error generated in the conveyance roller 28. The conveyance control unit 426 causes the signal output unit 522 to output a predetermined signal based on the calculation result, and this can change the driving mode of the conveyance roller 28.

The contents of the first and second embodiments can be combined with each other. For example, in S2030, based on the detection result of the sheet sensor 511 (based on whether the roll sheet is separated from the sheet sensor 511), it is determined whether formation of the loop 31 has been appropriately started. However, if processing in S2040 is not started after a predetermined time has elapsed, it may be determined whether a jam has occurred as in the first embodiment (see S1070 to S1110 in FIG. 6). For example, in the case shown in FIG. 5A (the case in which the loop 31 is appropriately formed), the sheet sensor 511 detects that no roll sheet is present. In the case shown in FIG. 5B (the case of the jam J1) and the case shown in FIG. 5C (the case of the jam J2), the sheet sensor 511 detects that the roll sheet is present.

According to the first and second embodiments exemplified above and modifications thereof, the signal output unit 522 outputs the predetermined signal based on the detection result of the loop sensor/sheet sensor 511 arranged between the rollers 28 and 29. By using the signal, it is possible to appropriately control driving of each component of the printing apparatus 1 in accordance with the detection result. The signal of the signal output unit 522 may have a multivalue, and this can achieve additional effects.

<Others>

Embodiment(s) of the present disclosure can also be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described embodiment(s) and/or that includes one or more circuits (e.g., application specific integrated circuit (ASIC)) for performing the functions of one or more of the above-described embodiment(s), and by a method performed by the computer of the system or apparatus by, for example, reading out and executing the computer executable instructions from the storage medium to perform the functions of one or more of the above-described embodiment(s) and/or controlling the one or more circuits to perform the functions of one or more of the above-described embodiment(s). The computer may comprise one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

In the above description, the printing apparatus 1 using an inkjet printing method has been taken as an example and described, but the printing method is not limited to the above-described mode. Further, the printing apparatus 1 may be a single-function printer having only a printing function, or a multifunction printer having a plurality of functions such as a printing function, a fax function, and a scanner function. Furthermore, the printing apparatus 1 may be, for example, a manufacturing apparatus for manufacturing a color filter, an electronic device, an optical device, a microstructure, or the like by a predetermined printing method.

The term "printing" in this specification should be interpreted in a broad sense. Accordingly, the mode of "printing" does not matter whether the object formed on a print medium is significant information such as characters and graphics, and also does not matter whether the object is visualized so that a human can visually perceive it.

Further, "printing medium" should be interpreted in a broad sense, similar to "printing" described above. The concept of "print medium" can include, in addition to paper which is generally used, any member that can accept ink, such as cloth, a plastic film, a metal plate, glass, ceramics, a resin, wood, leather, and the like.

Furthermore, "ink" should be interpreted in a broad sense, similar to "printing" described above. Accordingly, the concept of "ink" can include, in addition to a liquid that forms an image, a figure, a pattern, or the like by being applied onto a print medium, additional liquids that can be used for processing a print medium, processing ink (for example, coagulation or insolubilization of colorants in ink applied onto a print medium), or the like.

While the present disclosure has been described with reference to exemplary embodiments, it is to be understood that the disclosure is not limited to the disclosed exemplary embodiments. The scope of the following claims is to be accorded the broadest interpretation so as to encompass all such modifications and equivalent structures and functions.

This application claims the benefit of priority from Japanese Patent Application No. 2020-067821, filed on Apr. 3, 2020, which is hereby incorporated by reference herein in its entirety.

What is claimed is:

1. A printing apparatus comprising:

a storage unit configured to store a sheet;

a printing unit configured to perform printing on the sheet conveyed from the storage unit;

a first conveyance unit configured to convey the sheet toward the printing unit;

a second conveyance unit provided between the first conveyance unit and the storage unit and configured to convey the sheet from the storage unit toward the first conveyance unit;

a conveyance control unit configured to control driving of the first conveyance unit and driving of the second conveyance unit such that the sheet is bent between the first conveyance unit and the second conveyance unit; and a detection unit provided between the first conveyance unit and the second conveyance unit and configured to detect bending of the sheet, wherein, in a case where the first conveyance unit is in a state of conveying the sheet, the conveyance control unit determines whether to stop or not to stop conveyance of the sheet by the first conveyance unit based on a detection result of the detection unit.

2. The printing apparatus according to claim 1, further comprising a signal output unit configured to output, to the conveyance control unit and based on the detection result of the detection unit, a signal to control the second conveyance unit.

3. The printing apparatus according to claim 2, further comprising:

a cutter unit provided on an upstream side of the second conveyance unit in a conveyance path of the sheet and configured to cut the sheet conveyed from the storage unit; and a cutting control unit configured to control driving of the cutter unit based on the signal from the signal output unit.

4. The printing apparatus according to claim 3, wherein the signal output unit outputs a first signal in a case where the detection result of the detection unit indicates that the bending of the sheet satisfies a criterion, and outputs a second signal in a case where the detection result of the detection unit indicates that the bending of the sheet does not satisfy the criterion, wherein, in a case where the first signal is output, the cutting control unit drives the cutter unit while the conveyance control unit maintains driving of the first conveyance unit and suppresses driving of the second conveyance unit, and wherein, in a case where the second signal is output, the conveyance control unit suppresses driving of the first conveyance unit and driving of the second conveyance unit, and the cutting control unit suppresses driving of the cutter unit.

5. The printing apparatus according to claim 3, further comprising a determination unit configured to determine, as a determination result, a presence or absence of a jam in the conveyance path of the sheet, wherein based on the determination result, the conveyance control unit determines whether to drive the first conveyance unit and the second conveyance unit, and the cutting control unit determines whether to drive the cutter unit.

6. The printing apparatus according to claim 2, further comprising a notification unit configured to notify a user that the sheet is inappropriately conveyed in a case where the signal from the signal output unit indicates that the bending of the sheet does not satisfy a criterion.

7. The printing apparatus according to claim 2, wherein, in a case where the sheet is bent between the first conveyance unit and the second conveyance unit, the conveyance control unit changes a driving mode of the second conveyance unit based on the signal from the signal output unit.

8. The printing apparatus according to claim 7, wherein the detection unit is a first detection unit further configured to detect passage of the sheet, the printing apparatus further comprising:

a guide unit that is able to change whether to generate bending of the sheet and is configured to guide conveyance of the sheet from the second conveyance unit to the first conveyance unit; and a second detection unit configured to detect that the sheet conveyed from the storage unit has reached the second conveyance unit, wherein, in a state in which the guide unit does not allow generation of bending of the sheet, the conveyance control unit changes the driving mode of the second conveyance unit based on a difference between a detection time of the first detection unit and a detection time of the second detection unit.

9. The printing apparatus according to claim 8, wherein the conveyance control unit is configured to calculate, based on the difference between the detection time of the first detection unit and the detection time of the second detection unit, a sheet conveyance amount error generated in the second conveyance unit, and changes the driving mode of the second conveyance unit based on a result of the calculation.

10. The printing apparatus according to claim 7, wherein changing the driving mode of the second conveyance unit includes changing a driving force of the second conveyance unit.

11. The printing apparatus according to claim 7, wherein changing the driving mode of the second conveyance unit includes changing a driving time of the second conveyance unit.

12. A printing apparatus comprising:

a storage unit configured to store a sheet;

a printing unit configured to perform printing on the sheet conveyed from the storage unit;

a first conveyance unit configured to convey the sheet toward the printing unit;

a second conveyance unit provided between the first conveyance unit and the storage unit and configured to convey the sheet from the storage unit toward the first conveyance unit;

a conveyance control unit configured to control driving of the first conveyance unit and driving of the second conveyance unit such that the sheet is bent between the first conveyance unit and the second conveyance unit;

a detection unit provided between the first conveyance unit and the second conveyance unit and configured to detect bending of the sheet;

a signal output unit configured to output, to the conveyance control unit and based on the detection result of the detection unit, a signal to control the second conveyance unit a cutter unit provided on an upstream side of the second conveyance unit in a conveyance path of the sheet and configured to cut the sheet conveyed from the storage unit; and a cutting control unit configured to control driving of the cutter unit based on the signal from the signal output unit, wherein the conveyance control unit stops conveyance of the sheet by the first conveyance unit based on the detection result of the detection unit.

13. The printing apparatus according to claim 12, wherein the signal output unit outputs a first signal in a case where the detection result of the detection unit indicates that the bending of the sheet satisfies a criterion, and outputs a second signal in a case where the detection result of the detection unit indicates that the bending of the sheet does not satisfy the criterion, wherein, in a case where the first signal is output, the cutting control unit drives the cutter unit while the conveyance control unit maintains driving of the first conveyance unit and suppresses driving of the second conveyance unit, and wherein, in a case where the second signal is output, the conveyance control unit suppresses driving of the first conveyance unit and driving of the second conveyance unit, and the cutting control unit suppresses driving of the cutter unit.

14. The printing apparatus according to claim 12, further comprising a determination unit configured to determine, as a determination result, a presence or absence of a jam in the conveyance path of the sheet, wherein, based on the determination result, the conveyance control unit determines whether to drive the first conveyance unit and the second conveyance unit, and the cutting control unit determines whether to drive the cutter unit.

15. A method for controlling a printing apparatus having a storage unit configured to store a sheet, a printing unit configured to perform printing on the sheet conveyed from the storage unit, a first conveyance unit configured to convey the sheet toward the printing unit, a second conveyance unit provided between the first conveyance unit and the storage unit and configured to convey the sheet from the storage unit toward the first conveyance unit, and a detection unit provided between the first conveyance unit and the second conveyance unit and configured to detect bending of the sheet, the method comprising:

controlling driving of the first conveyance unit and driving of the second conveyance unit such that the sheet is bent between the first conveyance unit and the second conveyance unit; and determining, in a case where the first conveyance unit is in a state of conveying the sheet, whether to stop or not to stop conveyance of the sheet by the first conveyance unit based on a detection result of the detection unit.

16. The method according to claim 15, further comprising outputting, based on the detection result of the detection unit, a signal to control the second conveyance unit.

17. The method according to claim 16, wherein the printing apparatus further includes a cutter unit provided on an upstream side of the second conveyance unit in a conveyance path of the sheet and configured to cut the sheet conveyed from the storage unit, the method further comprising:

controlling driving of the cutter unit based on the signal from the signal output unit.

18. The method according to claim 17, wherein outputting includes outputting a first signal in a case where the detection result of the detection unit indicates that the bending of the sheet satisfies a criterion, and outputting a second signal in a case where the detection result of the detection unit indicates that the bending of the sheet does not satisfy the criterion, wherein, in a case where the first signal is output, controlling driving includes controlling driving of the cutter unit while maintaining driving of the first conveyance unit and suppressing driving of the second conveyance unit, and wherein, in a case where the second signal is output, controlling driving includes suppressing driving of the first conveyance unit and driving of the second conveyance unit, and suppressing driving of the cutter unit.

19. The method according to claim 17, further comprising determining, as a determination result, a presence or absence of a jam in the conveyance path of the sheet, wherein, based on the determination result, determining the presence or absence of the jam includes determining whether to drive the first conveyance unit and the second conveyance unit, and determining whether to drive the cutter unit.

* * * * *